US006002365A

United States Patent [19]

Page

[11] Patent Number: 6,002,365

[45] Date of Patent: Dec. 14, 1999

[54] ANTENNA BEAM STEERING USING AN OPTICAL COMMUTATOR TO DELAY THE LOCAL OSCILLATOR SIGAL

[76] Inventor: Derrick J. Page, 1645 Severn Chapel Rd., Crownsville, Md. 21032

[21] Appl. No.: 09/084,465

[22] Filed: May 26, 1998

[51] Int. Cl.[6] ..... H01Q 3/22

[52] U.S. Cl. ..... 342/375

[58] Field of Search ..... 342/368, 375

[56] References Cited

U.S. PATENT DOCUMENTS 4,028,702 6/1977 Levine ..... 343/854
5,325,102 6/1994 Page ..... 342/375
5,347,288 9/1994 Page ..... 342/375
5,475,392 12/1995 Newberg et al. ..... 342/375

*Primary Examiner*—Gregory C. Issing
*Attorney, Agent, or Firm*—H. C. Lin

[57] ABSTRACT

An array antenna is steered by changing the time delays of a local oscillator signal feeding a number of mixers, each fed by an individual antenna element. The beat frequency thus produced can be made in-phase by compensating time delays of different antenna elements in the array with different delays from the local oscillator. The delays from the local oscillator are obtained with optical fibers of variable lengths.

9 Claims, 4 Drawing Sheets

ANTENNA BEAM STEERING USING AN OPTICAL COMMUTATOR TO DELAY THE LOCAL OSCILLATOR SIGAL

BACKGROUND OF THE INVENTION

1. Field of the Invention

This invention relates to array antennas and is particularly concerned with providing time delay steering to array antenna elements. Co-pending with this application are U.S. patent application Ser. Nos. 09/017,099 now U.S. Pat. No. 5,923,291 filed Feb. 2, 1998; 09/020,112 now U.S. Pat. No. 5,856,805 filed Feb. 6, 1998; and 09/032,937 filed Mar. 2, 1998.

2. Description of the Prior Art

An array antenna consists of a group of antenna elements uniformly spaced apart to form an array. The array can be used for transmitting a beam of microwave energy in a chosen direction or receiving a microwave signal from a particular direction. This beam steering is achieved by controlling the relative timing or phasing of the individual elements.

Controlling the relative phase of each of the antenna elements requires that each element contain a phase shifting device and that an electronic control system be used to control the phase of each of the elements. Such antenna systems, referred to as phased arrays, are employed in applications where it is required to steer the beam rapidly in space and where the use of parabolic dish antennas is not practical. However, the wide scale use of phased arrays has been limited by the high cost of their complex circuitry.

Another technique that is used to steer the beam in an array antenna is to control the relative timing of the transmitted or received signal at the array element. In the transmission mode, if the signal at each of the elements is emitted in unison, a wavefront is formed that is parallel to the plane of the array. The signal beam is directed perpendicular to the wavefront, therefore, when the signal is emitted from the antenna elements in unison, the beam is directed perpendicular to the plane of the array (the boresight direction). When the emission from the antenna elements is not in unison, but is varied in time along the array the angle of the wavefront relative to the plane of the array will change and the beam will be steered away from boresight. If, for example, the signal emission from any element relative to its nearest adjacent element is delayed a time t and each element is spaced a distance D apart, the steered angle $\phi$ between the boresight direction and the beam direction is given by the formula $\sin \phi = t\ c/D$, where c represents the velocity of electromagnetic propagation in space. True-time delay techniques allow antenna arrays to operate over extremely wide frequency ranges as the delay techniques are frequency independent.

The use of fiberoptic communication systems is known. A commercially available laser unit can be used to convert a microwave signal to an intensity modulated optical signal. The optical signal travels through the optical fiber to where it is converted back to a microwave signal by an optical detector and a microwave amplifier, which are commercially available.

Optical techniques have been suggested to control array elements. Schemes have been proposed to use a selection of optical fibers with lengths arranged in a binary or quadratic sequence and to switch in a series string combination to achieve a desired timing. This would result in a very complex control scheme employing thousands of optical fibers and optical switches for even the simplest array.

An optical commutator scheme using two sets of fiber optics, each having a parabolic distribution of lengths has been described. By aligning these two sets of fibers and moving one set relative to the other, a linear and variable set of delay paths can be generated which can be incorporated into an antenna array to provide the timing needed to form and steer the beam. This technique has been described as applied to a receiver system in U.S. Pat. No. 5,325,102. This system is complicated because each receiving element must produce an intensity modulated signal that is representative of the signal being received by that particular element. This means that every receiving element of the antenna array must have a light generation means such as a laser diode. Laser diodes are expensive, particularly those that are capable of being modulated at high frequency.

SUMMARY OF THE INVENTION

An object of this invention is to provide a device that performs the steering and timing function for an antenna array. Another object of this invention is to use only one light source instead of using an expensive light generation means such as a laser diode for every receiver element of the antenna array. Still another object of this invention is to use the concept for both a receiving and transmitting antenna.

The object is achieved in the case of a receiving antenna by fitting each of the elements in the array with a low noise amplifier which in turn passes the received signal to one of a group of mixers. The mixer converts the signal to a lower base band signal by multiplying the received signal with the local oscillator frequency signal. The local oscillator signal is distributed to each of the mixers by means of an optical commutator that adjusts the timing of the signal fed to any particular mixer so that a beam may be formed. As the optical commutator is moved, the received signal pointing direction will move in space.

DETAILED DESCRIPTION OF THE PREFERRED EMBODIMENT

Figure 1:
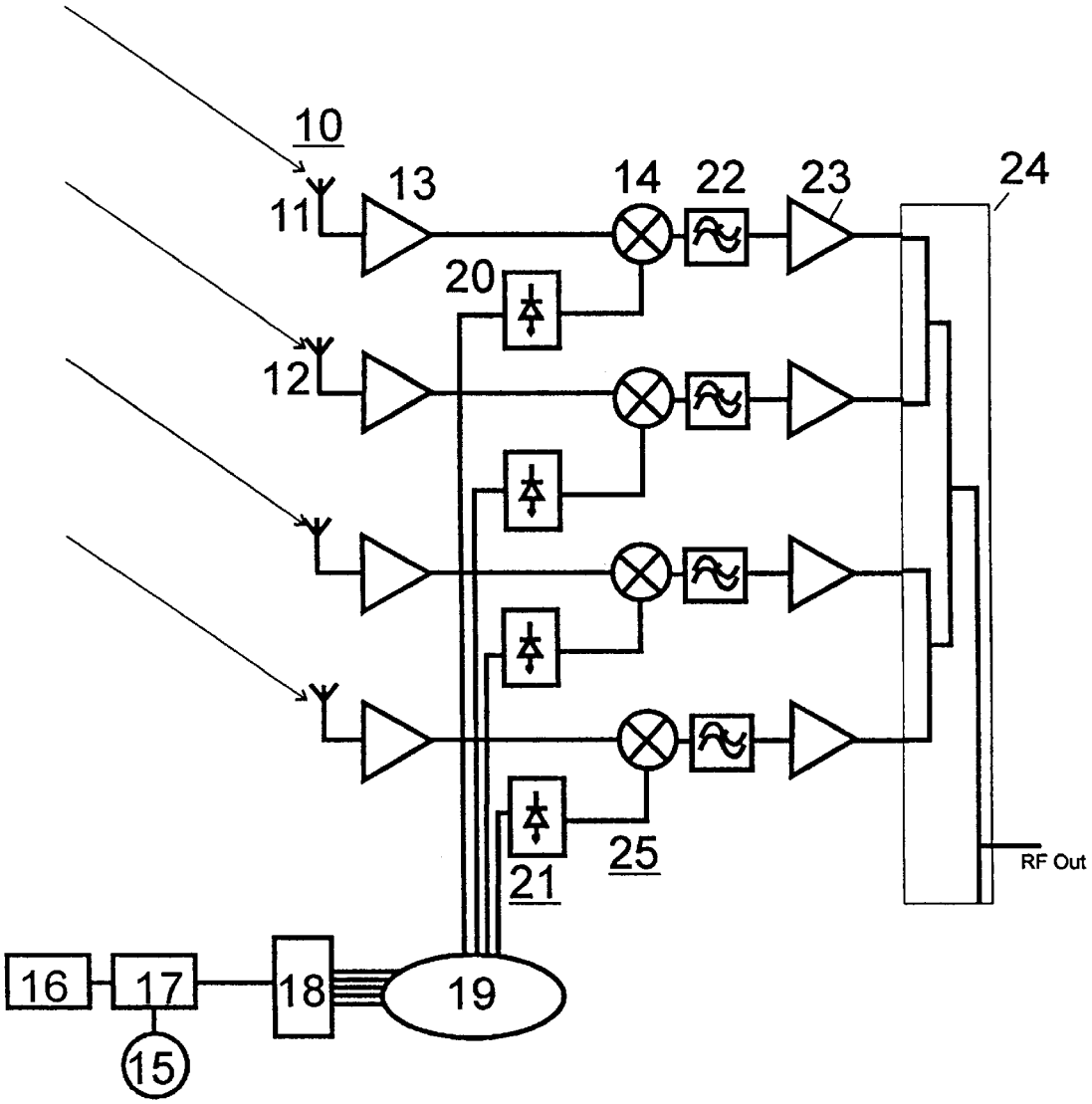
FIG. 1 is a schematic represention showing the components of the circuit of a receiving system employing an optical commutator to form a beam.

Referring to FIG. 1, which shows the preferred circuit arrangement of the invention, a planar antenna array 10 receives signals from a distant source. The element 11 is shown to receive the signal earlier than element 12 as element 11 is closer to the source. The signal received by element 11 is first amplified by amplifier 13 and then fed to mixer 14 where it is mixed with the local oscillator frequency. The local oscillator frequency is generated by frequency generator 15 and is used to intensity modulate light from laser 16 using optical modulator 17. The intensity modulated light is then split into a number of parallel paths by optical splitter 18 and each path is fed to optical commutator 19 which imposes an ordered time delay on each optical path. From the optical commutator each optical path is connected to an optical detector system 20, being one of optical detector group 21. The optical detector system converts the intensity modulated optical signal back into an electrical signal of the same local oscillator frequency as that generated by generator 15, but delayed in time. From the detector system the signal is fed as the local oscillator frequency to the mixer 14.

The mixer 14 performs a multiplication of the signal received by antenna element 11 with the local oscillator frequency from 20. If the frequency being received by 11 is $f_1$ and the local oscillator frequency is $f_2$, the output of the mixer will be two frequencies, $f_1+f_2$ and $f_1-f_2$.

From the mixer 14 the signal then passes through the filter 22 that discards one of the frequency products and passes the other to the amplifier 23. The output of the amplifier is then fed to combiner 24. All the signals from the other elements in the array are treated in a similar fashion and the signals arriving in all the parallel paths to the combiner are in phase and will add coherently in the combiner to give a common output that is representative of a signal being received by the array from a particular direction.

Figure 3:
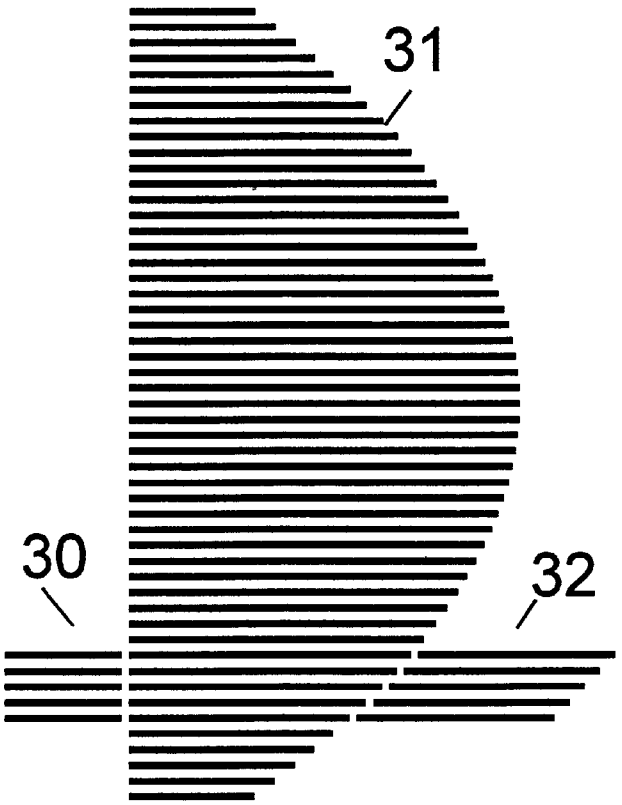
FIG. 3 shows a representation of the optical fibers of an optical commutator set to form a beam at an angle to the array face.
Figure 2:
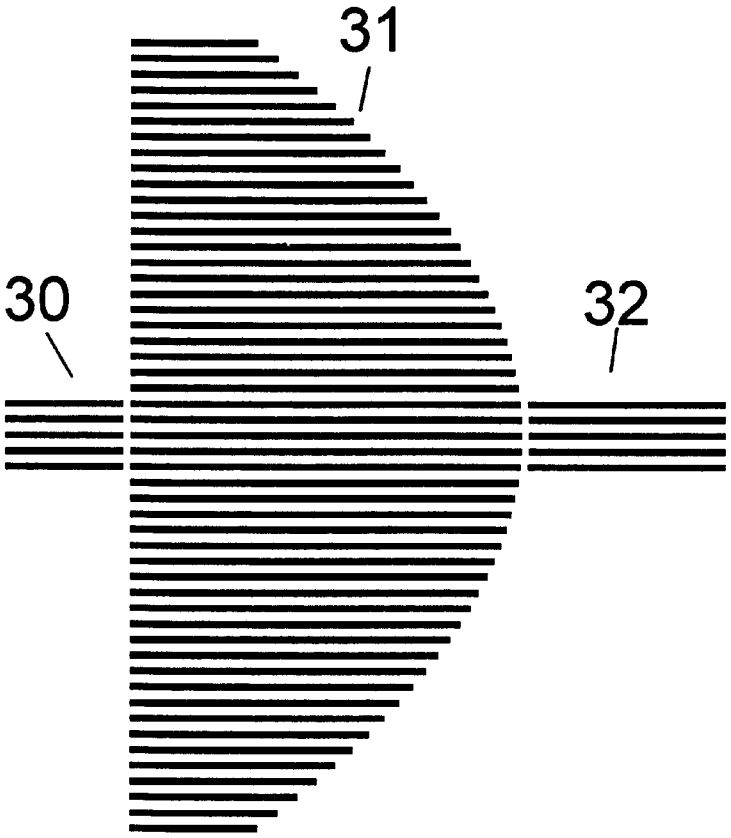
FIG. 2 shows a representation of the optical fibers of an optical commutator set to form a beam perpendicular to the array face.

This is best understood by referring to FIG. 2 which shows a histogram representing the lengths of the optical fibers in the optical commutator. Input set 30 come from the optical splitter 18 of FIG. 1 and are aligned with set 31 which has a parabolic distribution of lengths. Output set 32 also has a parabolic set of fibers that are connected to detector systems 21 of FIG. 1. The set 31 can be moved relative to sets 30 and 32 to give a group length that varies linearly across the set. This is shown in FIG. 3, where the set 31 has be moved away from the center position of FIG. 2 and the combined lengths of set 30, 31 and 32 vary linearly across the set. The variation in length across the set, shortest to longest, varies in proportion to the movement of set 31. Hence by moving the set 31, the signals passing through the set can be delayed by an adjustable amount and the delay imposed varies linearly across the set. The relative movement of set 31 can be linear or circular. If the antenna array is circular rather than planar, the set 31 must have a cosinusoidal distribution of length and set 32 will all have the same length.

The timing of the local oscillator frequency signals, arriving at the mixer set 25 in the parallel paths, can be controlled by moving the fiber set 31 within the optical commutator.

Figure 4:
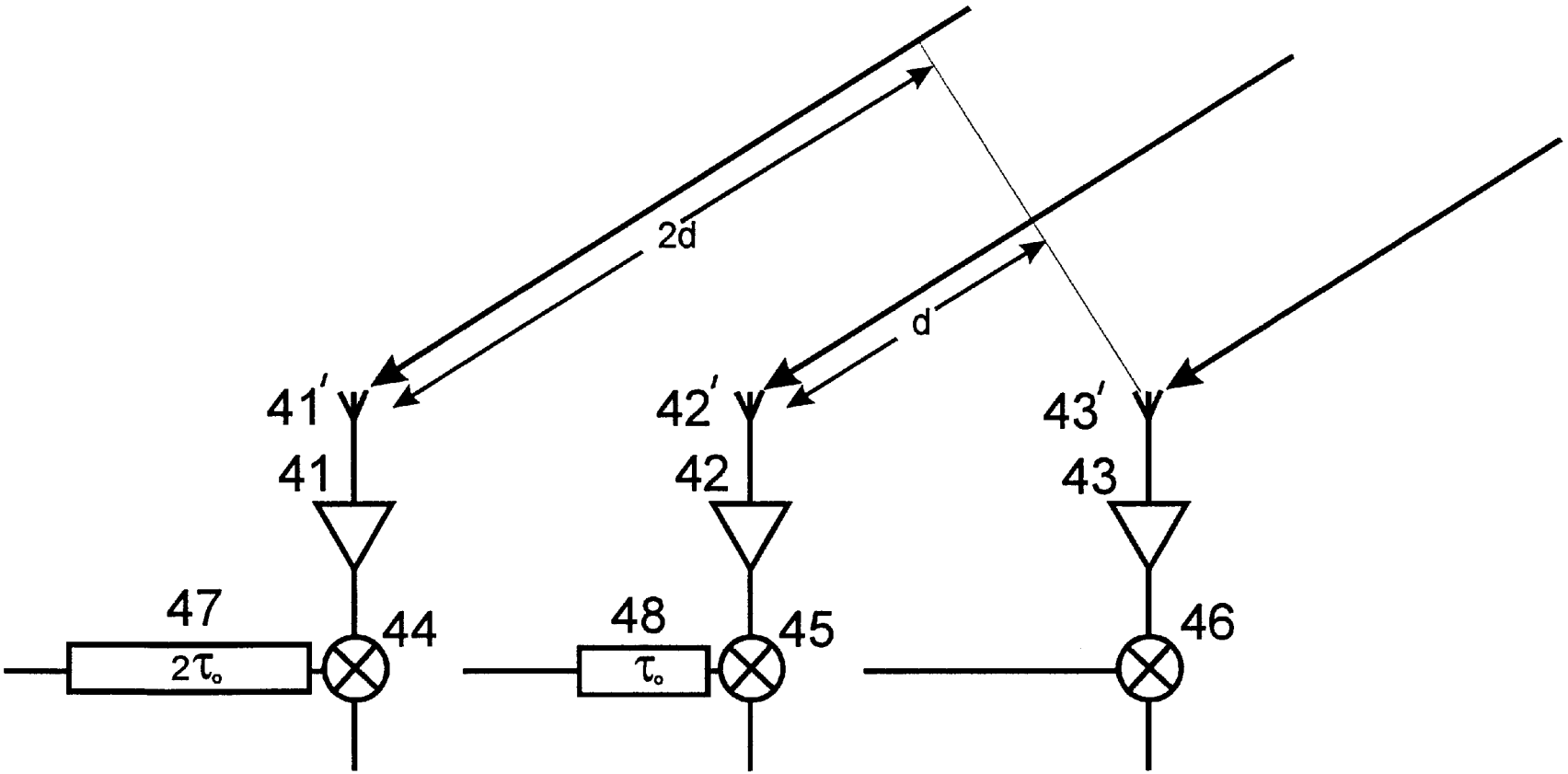
FIG. 4 shows a representation of three adjacent receiving antenna elements.

To understand the beamforming aspect of the system, consider the signals arriving from a common source at three adjacent elements 41', 42' and 43' of a uniformly spaced antenna array shown in FIG. 4. The signals may be amplified by amplifiers 41, 42 and 43 before being fed to mixers 44, 45 and 46. The signal arriving at mixer 46 will be ahead of the signal arriving at mixer 45 by the time $\tau_i$ it takes the electromagnetic radiation to traverse distance d. Likewise, the signal arriving at mixer 46 will be ahead of the signal arriving at mixer 44 by an amount $2\tau_i$. The input to mixer 46 can be represented by $v \sin \omega_I(t)$, where $\omega_I$ is the angular frequency of the signal being received and v is the amplitude after amplification. Similarly the input signal to mixer 45 can be represented by $v \sin \omega_I(t-\tau_i)$ and the input to mixer 44 can be represented by $v\sin \omega_I(t-2\tau_i)$.

A local oscillator is used to feed the three mixers. The local oscillator signal being fed to mixer 46 can be represented by $u \cos \omega_0(t)$, where $\omega_0$ is the angular frequency of the local oscillator and u is the amplitude. The local oscillator signal being fed to mixer 45 is delayed by delay means 48 and can be represented by $u\cos \omega_0(t-\tau_0)$ where $\tau_0$ is the time delay introduced by the delay means 48. The local oscillator signal being fed to mixer 44 can be represented by $u \cos \omega_0(t-2\tau_0)$ as the local oscillator is delayed by delay means 47 which is twice as long as delay means 48. The outputs of the mixers are given by the product of the respective input signals and the respective local oscillator signals. Considering the lower of the two output frequencies:

The output of mixer 46 is given by $uv \sin[(\omega_i-\omega_0)t]$, the output of mixer 45 is given by $uv \sin[(\omega_i-\omega_0)t+\omega_0\tau_0-\omega_I\tau_i]$, and the output of mixer 44 is given by $uv \sin[(\omega_i-\omega_0)t+\omega_0 2\tau_0-\omega_i 2\tau_i]$ By making the magnitude of delay $\tau_0$ of 48 equal to $$\frac{\omega_i}{\omega_o}\tau_i$$

and that of 47 equal to $$\frac{\omega_i}{\omega_o}2\tau_i,$$

the last two terms in the expressions cancel one another and the outputs of all of the mixers become the same and equal to $uv \sin[(\omega_i-\omega_0)t]$.

Hence the outputs of the mixers are in phase and can be summed coherently for a particular angle of arrival of the signal to the antenna array to obtain a received signal. If the angle of arrival is changed, the magnitude of the delay imposed on each of the mixers may also be changed using the variable fiber lengths of the commutator illustrated in FIG. 3 so that the outputs of the mixers will again sum coherently and a signal will be obtained that corresponds to the signal arriving from the new direction. This example has used 3 elements in a row, but the principle can be extended to any number of elements in a row.

The application of the optical commutator being used to control the timing on a group of mixers of a receiving system has been described. The same principle may be employed for a transmitting array.

Figure 5:
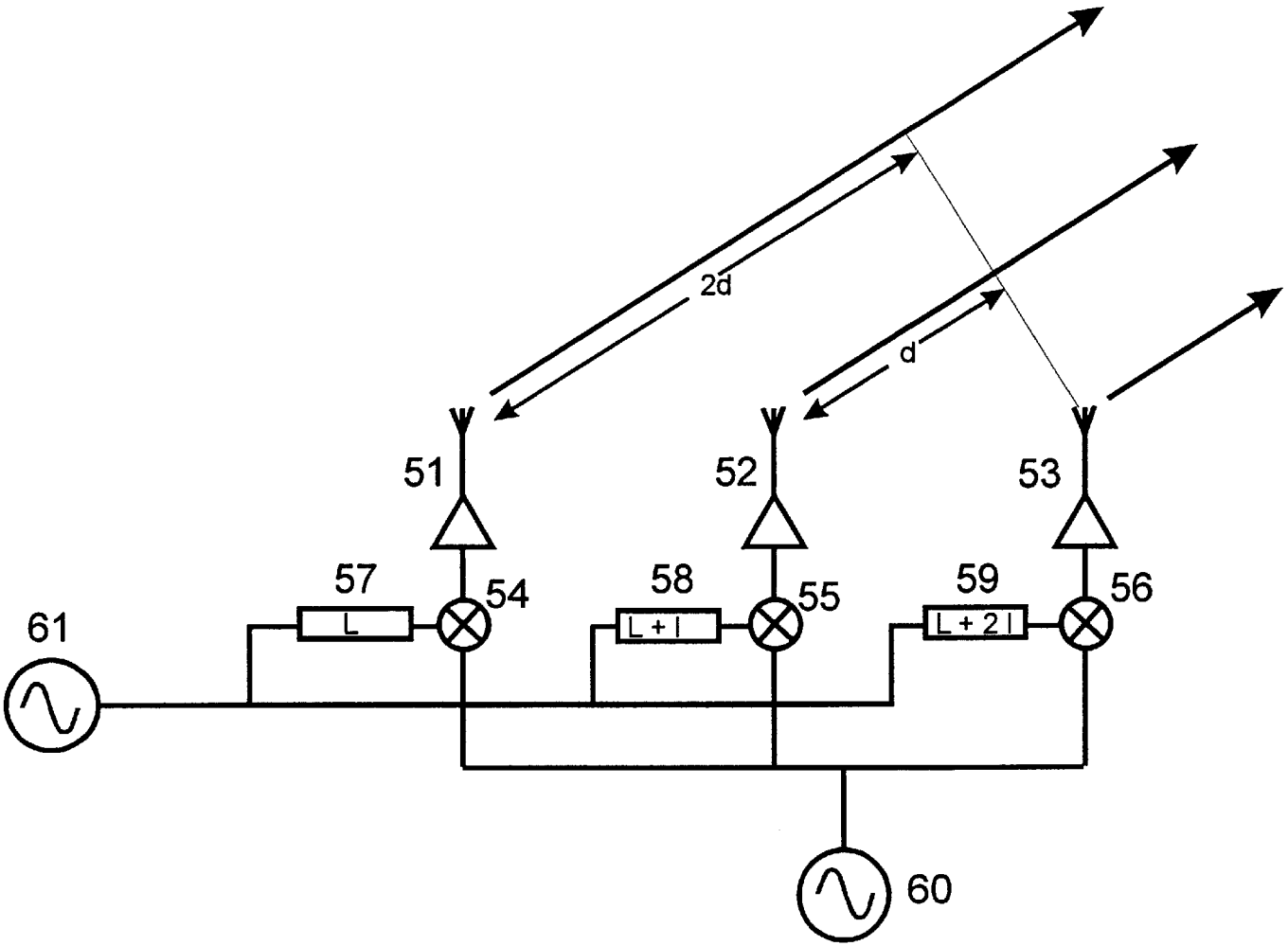
FIG. 5 is schematic representation showing the components of the circuit of a transmitting system employing an optical commutator to form a beam.

A schematic circuit of the transmitting system is shown in FIG. 5. The signal is generated by signal generator 60 and then split into the number of parallel paths equal to the number of transmitting elements in the array. The signal is then fed to up-converting mixers 54, 55 and 56. Each path from the signal generator to the mixers is of the same length. A local oscillator 61 is used to generate the local oscillator signal that is divided and fed through the variable delay lines of the optical communicator 57, 58 and 59 to the mixers 54, 55, and 56. Each of the mixers then up converts the signal frequency to a new frequency, given by the sum of the signal frequency, and the local oscillator frequency, and then feeds the signal to each antenna element via the power amplifiers 51, 52 and 53. Although FIG. 4 depicts only three antenna elements, it is understood that the principle can be extended to any number of elements in a row of the array. Using an analysis similar to the described earlier for the receiver, it can be shown that the signals emerging from the antenna elements are delayed by an amount that is the same as the delay applied to the local oscillator signal by the optical commutator. By adjusting the delays imposed by the optical commutator the transmitted beam may be steered in space.

The foregoing description illustrates the preferred embodiments of the present invention, and is by no means limited to these examples. Any equivalent techniques to implement the structures are all within the scope of this invention.

What is claimed is:

1. A device for delaying electromagnetic (EM) wave signals coupled to elements of an array antenna and having a wavefront not necessarily parallel to the plane of said array antenna, the device providing delay paths of selectable length between the respective elements and a receiving unit, the device comprising:

a local oscillator generating a second signal having a frequency different from said EM wave signals; and a plurality of mixers for mixing said EM wave signals from each one of said elements with said second signal;

a plurality of selectable delay paths between said local oscillator and said mixer to produce in-phase beat frequency signals which are fed to the input of the receiving unit, wherein said selectable delay paths comprise:

a set of first fiber optical lines, each first fiber optic line having a first end coupled to said local oscillator and having a selectable length which varies incrementally in sequence, and a second end, a set of second fiber optical lines, each second fiber optic line having a first end coupled to said second end of one of said first fiber optic lines, a second end, and a selectable length which varies incrementally in sequence, a set of third fiber optical lines, each third fiber optic line having a first end coupled to said second end of one of said second fiber optic lines, and a second end coupled to one of said mixers, and means for moving the set of second optical fibers with respect to the set of first fiber optic lines and the set of third fiber lines, wherein one of said first set of fiber optical lines, one of said second set of fiber optical lines and one of said third set of fiber optical lines constitute one of said delay paths.

2. A device for delaying EM wave signals as described in claim 1, wherein said selectable length in said first set is incremented parabolically in sequency.

3. A device for delaying EM wave signals as described in claim 1, wherein said selectable length in said second set is incremented parabolically in sequence.

4. A device for delaying EM wave signals as described in claim 1, wherein said selectable length in said second set is incremented cosinusoidally in sequence.

5. A device for delaying EM wave signals as described in claim 1, wherein said means for moving is a linear translation.

6. A device for delaying signals coupled to elements of an array antenna and having a wavefront not necessarily parallel to the plane of said antenna, the device providing delay paths of selectable lengths between a transmitting unit and the respective elements, the device compromising:

a signal generator generating a signal of first frequency;

a local oscillator generating a second signal having a frequency different from said first frequency;

a plurality of mixers for mixing said signal of first frequency with said second signal to produce a beat frequency signal to feed different said elements, and a plurality of selectable delay paths between said local oscillator and said plurality of mixers selected to phase the beat frequency signal such that the wave front of said array antenna is steered, wherein said selectable delay paths comprise:

a set of first fiber optical lines, each fiber optic line having a first end coupled to said local oscillator, and a second end, a set of second fiber optical lines, each second fiber optic line having a first end coupled to said second end of one of said first fiber optic lines, a second end, and a selectable length which varies incrementally in sequence, a set of third optical lines, each third fiber optic line having a first end coupled to said second end of one of said second fiber optic lines, and a second end coupled to one of said mixers, and means for moving the set of second fiber optical lines with respect to the set of first fiber optical lines and the third set of said fiber optical lines.

7. A device for delaying signals as described in claim 6, wherein said selectable length in said first set is incremented parabolically in sequence.

8. A device for delaying signals as described in claim 6, wherein said selectable length in said second set is incremented parabolically in sequence.

9. A device for delaying signals as described in claim 6, wherein said selectable length in said second set is incremented cosinusoidally in sequence.

* * * * *